US007569283B2

(12) United States Patent
Kool

(10) Patent No.: US 7,569,283 B2
(45) **Date of Patent: *Aug. 4, 2009**

(54) ALUMINIZING COMPOSITION AND METHOD FOR APPLICATION WITHIN INTERNAL PASSAGES

(75) Inventor: Lawrence Bernard Kool, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 301 days.

This patent is subject to a terminal disclaimer.

(21) Appl. No.: 11/619,543

(22) Filed: Jan. 3, 2007

(65) Prior Publication Data

US 2007/0128457 A1 Jun. 7, 2007

Related U.S. Application Data

(62) Division of application No. 10/836,001, filed on Apr. 29, 2004, now Pat. No. 7,332,024.

(51) Int. Cl.

| | |
|---|---|
| ***B32B 15/16*** | (2006.01) |
| ***B32B 15/20*** | (2006.01) |
| ***B32B 15/01*** | (2006.01) |
| ***B22F 7/04*** | (2006.01) |
| ***B05D 7/14*** | (2006.01) |
| ***B05D 7/22*** | (2006.01) |
| ***B05D 7/24*** | (2006.01) |

(52) U.S. Cl. ..... 428/564; 428/553; 428/560; 428/650; 427/192; 427/235; 427/239; 427/383.1

(58) Field of Classification Search ..... None
See application file for complete search history.

(56) References Cited

U.S. PATENT DOCUMENTS

| | | | |
|---|---|---|---|
| 2,541,813 | A | 2/1951 | Frisch et al. |
| 3,242,851 | A | 3/1966 | Brawley et al. |
| 3,248,251 | A | 4/1966 | Allen |
| 4,027,073 | A | 5/1977 | Clark |
| 4,208,454 | A | 6/1980 | Reed et al. |
| 4,542,048 | A | 9/1985 | Nickola et al. |
| 4,617,202 | A | 10/1986 | Baldi |
| 4,748,194 | A | 5/1988 | Geeck |
| 4,774,278 | A | 9/1988 | Yoshioka et al. |
| 5,011,627 | A | 4/1991 | Lutz et al. |
| 5,041,309 | A | 8/1991 | Davis et al. |
| 5,043,378 | A | 8/1991 | Packer et al. |
| 5,102,700 | A | 4/1992 | Baldi |
| 5,208,071 | A | 5/1993 | Davis et al. |
| 5,318,850 | A | 6/1994 | Pickett et al. |
| 5,322,864 | A | 6/1994 | Sugimoto et al. |
| 5,366,765 | A | 11/1994 | Milaniak et al. |
| 5,399,313 | A | 3/1995 | Ross et al. |
| 5,547,770 | A | 8/1996 | Meelu et al. |
| 5,650,235 | A | 7/1997 | McMordie et al. |
| 5,759,932 | A | 6/1998 | Sangeeta et al. |
| 6,074,464 | A | 6/2000 | Eddinger et al. |
| 6,086,997 | A | 7/2000 | Patel et al. |
| 6,150,033 | A | 11/2000 | Mosser et al. |
| 6,224,657 | B1 | 5/2001 | Myers et al. |
| 6,335,057 | B1 | 1/2002 | Noura et al. |
| 6,362,434 | B1 | 3/2002 | Yoshida |
| 6,368,394 | B1 | 4/2002 | Hughes et al. |
| 6,372,299 | B1 | 4/2002 | Thompson et al. |
| 6,428,630 | B1 | 8/2002 | Mor et al. |
| 6,444,054 | B1 | 9/2002 | Kircher et al. |
| 6,805,906 | B2 | 10/2004 | Moravek et al. |
| 7,270,852 | B2 * | 9/2007 | Kool et al. ..... 427/383.1 |
| 7,449,241 | B2 * | 11/2008 | Gigliotti et al. ..... 428/413 |
| 2003/0152705 | A1 | 8/2003 | Pfaendtner et al. |
| 2004/0115355 | A1 | 6/2004 | Bauer et al. |
| 2005/0031781 | A1 | 2/2005 | Kool et al. |
| 2005/0031877 | A1 | 2/2005 | Gigliotti et al. |
| 2005/0127039 | A1 | 6/2005 | Rosenzweig et al. |
| 2007/0298166 | A1 * | 12/2007 | Kool et al. ..... 427/230 |

FOREIGN PATENT DOCUMENTS

| | | |
|---|---|---|
| EP | 1065296 A1 | 1/2001 |
| EP | 1411093 A1 | 4/2004 |

(Continued)

OTHER PUBLICATIONS

Charles A. Marten, Technology of Paints, Varnishes and Lacquers, Reinhold Book Corporation, 1968, pp. 230-243 and 254-255.

(Continued)

*Primary Examiner*—Jennifer McNeil
*Assistant Examiner*—Jason L Savage
(74) *Attorney, Agent, or Firm*—Ann M. Agosti

(57) ABSTRACT

An aluminizing composition includes an aluminum-based powder, an inert organic pyrolysable thickener, and a binder selected from the group consisting of colloidal silica, at least one organic resin, and combinations thereof. A method for aluminizing an internal passage of a metal substrate comprises injecting the organic-based aluminizing composition into the internal passage, heat treating the composition under conditions sufficient to remove volatile components from the composition, to cause diffusion of aluminum into surface regions of the internal passage, and to cause decomposition of at least some pyrolysable thickener particles, and burnishing excess material from the internal passage.

23 Claims, No Drawings

FOREIGN PATENT DOCUMENTS

| | | | |
|---|---|---|---|
| EP | 1505176 | A1 | 2/2005 |
| EP | 1591552 | A1 | 11/2005 |
| FR | 885585 | A | 9/1943 |
| GB | 2058844 | A | 4/1981 |
| JP | 52133836 | A | 11/1977 |
| JP | 58173994 | | 9/1983 |
| JP | 1332933 | | 12/1989 |
| JP | 5255517 | A | 10/1993 |
| WO | 2007056156 | A1 | 5/2007 |

OTHER PUBLICATIONS

EPO Search Report Dated Aug. 11, 2005.

* cited by examiner

ALUMINIZING COMPOSITION AND METHOD FOR APPLICATION WITHIN INTERNAL PASSAGES

CROSS REFERENCE TO RELATED APPLICATIONS

This application is a Division of a U.S. patent application Ser. No. 10/836,001 entitled "Aluminizing Composition and Method for Application within Internal Passages" filed Apr. 29, 2004, now U.S. Pat. No. 7,332,024 which is herein incorporated by reference.

BACKGROUND

The invention relates generally to aluminizing compositions and methods of applying such compositions within internal passages.

Many types of metals are used in industrial applications. When the application involves demanding operating conditions, specialty metals and alloys are often required. As an example, components within gas turbine engines operate in a high-temperature environment. The specialty alloys must withstand in-service temperatures in the range of about 650° C.-1200° C. Moreover, the alloys may be subjected to repeated temperature cycling.

In the case of turbine engines, the substrate is often formed from a nickel-base or cobalt-base superalloy. The term "superalloy" is usually intended to embrace complex cobalt- or nickel-based alloys which include one or more other elements such as aluminum, tungsten, molybdenum, titanium, and iron. The quantity of each element in the alloy is carefully controlled to impart specific characteristics. Aluminum is a particularly important component for many superalloys. It imparts environmental resistance to the alloys, and can also improve their precipitation-strengthening.

Superalloy substrates are often coated with protective metallic coatings. One example of the metallic coating is an MCrAl(X)-type material, where M is nickel, cobalt, or iron, and X is an element selected from the group consisting of Y, Ta, Si, Hf, Ti, Zr, B, C, and combinations thereof. Another type of protective metallic coating is an aluminide material, such as nickel-aluminide or platinum-nickel-aluminide.

If the superalloy is exposed to an oxidizing atmosphere for an extended period of time, it can become depleted in aluminum. This is especially true when the particular superalloy component is used at the elevated temperatures described above. The aluminum loss can occur by way of various mechanisms. For example, aluminum can diffuse into the overlying protective coating, be consumed during oxidation of the protective coating, or be consumed during oxidation at the coating/substrate interface.

Since loss of aluminum can be detrimental to the integrity of the superalloy, techniques for countering such a loss have been investigated. At elevated temperatures, the substrate can be partially replenished with aluminum which diffuses from an adjacent MCrAlX coating. However, the amount of aluminum diffusion into the substrate from the MCrAlX coating may be insufficient.

One method for increasing the aluminum content of the superalloy substrate in its surface region is sometimes referred to in the art as "aluminiding" or "aluminizing". In such a process, aluminum is introduced into the substrate by a variety of techniques. In the "pack aluminiding" process, the substrate is immersed within a mixture (or pack) containing the coating element source, filler material, and a halide activating agent. At high temperatures (usually about 700-750° C.), reactions within the mixture yield an aluminum-rich vapor which condenses onto the substrate surface. During a subsequent heat treatment, the condensed aluminum-based material diffuses into the substrate.

Slurry compositions are employed in another method for incorporating aluminum into the surface of a superalloy. For example, an aqueous or organic slurry containing aluminum in some form can be sprayed or otherwise coated onto the substrate. The volatile components are then evaporated, and the aluminum-containing component can be heated in a manner which causes the aluminum to diffuse into the substrate surface.

Important advantages are associated with using slurries for aluminizing the substrates. For example, slurries can be easily and economically prepared, and their aluminum content can be readily adjusted to meet the requirements for a particular substrate. Moreover, the slurries can be applied to the substrate by a number of different techniques, and their wetting ability helps to ensure relatively uniform aluminization.

Slurry compositions typically rely on the presence of chromates, which are considered toxic. In particular, hexavalent chromium is also considered to be a carcinogen. When compositions containing this form of chromium are used (e.g., in spray booths), special handling procedures have to be very closely followed, in order to satisfy health and safety regulations. The special handling procedures can often result in increased costs and decreased productivity.

Some attempts have been made to formulate slurry compositions which do not rely on the presence of chromates. Many of the compositions are based on an aqueous phosphoric acid bonding solution, which comprises a source of magnesium, zinc, and borate ions. The coatings are said to be very satisfactory, in terms of oxidation- and corrosion resistance. However, the chromate-free slurry compositions may be accompanied by other serious drawbacks. For example, they are sometimes unstable over the course of several hours (or even several minutes), and may also generate unsuitable levels of gasses such as hydrogen. Furthermore, the compositions have been known to thicken or partially solidify during those time periods, making them very difficult to apply to a substrate by spray techniques. Moreover, the use of phosphoric acid in the compositions may also contribute to their instability. This is especially true when chromate compounds are not present, since the latter apparently passivate the surface of the aluminum particles. In the absence of the chromates, any phosphoric acid present may attack the aluminum metal in the slurry composition, rendering it thermally and physically unstable. At best, such a slurry composition will be difficult to store and apply to a substrate.

In several commonly assigned U.S. patent application Ser. Nos. 10/633,888 and 10/633,887, which are herein incorporated by reference in their entirety, an environmentally-friendly (substantially hexavalent chromium-free) slurry aluminizing processes is described for coating external surfaces of turbine components.

Internal passages are generally present in gas turbine components to allow for the passage of cooling air. As gas turbine temperatures have increased, the geometries of these cooling passages have become progressively more circuitous and complex. Although the techniques in aforementioned U.S. patent application Ser. Nos. 10/633,888 and 10/633,887 were found to be useful for coating external surfaces without relying on the presence of chromates and with increased stability, parts requiring internal aluminizing continued to be shipped to remote locations to be treated with a vapor phase aluminizing process.

It would therefore be desirable to have a composition and method to facilitate aluminizing of internal cooling passages without requiring vapor phase aluminizing processes.

BRIEF DESCRIPTION

Briefly, in accordance with one embodiment of the present invention, an aluminizing composition comprises: an aluminum-based powder, a binder selected from the group consisting of colloidal silica, at least one organic resin, and combinations thereof, and an inert organic pyrolysable thickener.

In accordance with another embodiment of the present invention, a method for aluminizing an internal passage of a metal substrate comprises: injecting into the internal passage an aluminizing composition comprising an aluminum-based powder, inert organic pyrolysable thickener particles, and a binder selected from the group consisting of colloidal silica, at least one organic resin, and combinations thereof; heat treating the composition under conditions sufficient to remove volatile components from the composition, to cause diffusion of aluminum into surface regions of the internal passage, and to cause decomposition of at least some of the inert organic pyrolysable thickener particles; and burnishing excess material from the internal passage.

In accordance with another embodiment of the present invention, a metal substrate has a coating disposed on an internal passage, said coating being free of hexavalent chromium, and comprising aluminum-based powder, an inert organic pyrolysable thickener, and a binder selected from the group consisting of colloidal silica, at least one organic resin, and combinations thereof.

DETAILED DESCRIPTION

In accordance with one embodiment of the present invention, an aluminizing composition comprises: an aluminum-based powder; a binder selected from the group consisting of colloidal silica (for aqueous-based compositions, as are discussed in further detail below), at least one organic resin (for organic-based compositions, as are also discussed in further detail below), and combinations thereof; and an inert organic pyrolysable thickener. The composition can be used for aluminizing an internal passage of a metal substrate by injecting the composition into the internal passage; heat treating the composition under conditions sufficient to remove volatile components from the composition, to cause diffusion of aluminum into surface regions of the internal passage, and to cause decomposition of at least some of inert organic pyrolysable particles; and burnishing excess material from the internal passage.

As used herein "pyrolysable" means capable of thermal decomposition. Typically the inert pyrolysable thickener comprises a solid organic particulate thickener. Ideal material properties for the inert pyrolysable organic thickener are: being inert while occupying space, capable of vaporizing without leaving residue, and being environmentally friendly. By varying the consistency (the amount, for example) of inert organic pyrolysable thickener particles, the resulting material properties can changed. For example, increased amounts of inert organic pyrolysable thickener increase the firmness of the composition.

Selected embodiments of the present invention can be designed such that the composition is substantially free of hexavalent chromium and that the composition comprises less than about 10% by weight of phosphoric acid and phosphoric acid derivatives, based on the weight of the entire composition.

Example structures for the inert organic pyrolysable thickener include beads, yarns, strings, fibers, and combinations thereof. Example materials for the inert organic pyrolysable thickener include acrylics, polymers, and more specifically, poly(methyl methacrylate). More specific examples of shapes include microbeads. In one example, the inert organic pyrolysable thickener comprises poly(methyl methacrylate) beads. A non-limiting example diameter for such beads is 200 micrometers.

In a more specific aspect of the present invention, the above-described composition further comprises a water soluble polymeric thickener such as polyvinyl alcohol, for example.

Example properties of the aluminum-based powder and binders are described in aforementioned U.S. patent application Ser. Nos. 10/633,888 and 10/633,887. These properties are also useful within the composition of the present invention and are briefly described herein.

The aluminum-based powder can be used in a variety of standard sizes. The size of the powder particles will depend on several factors, such as the type of substrate, the identity of the other components present in the composition, and the relative amounts of those components. Usually, the powder particles have an average particle size in the range of about 0.5 micron to about 200 microns. In some embodiments, the powder particles have an average particle size in the range of about 1 micron to about 50 microns. In even more specific embodiments, the average particle size is in the range of about 1 micron to about 20 microns.

As used herein, an "aluminum-based powder" is defined as one which contains at least about 75% by weight aluminum, based on total elements present. Thus, the powder may contain other elements which impart various characteristics to the substrate material. For example, the powder may contain at least one platinum group metal, such as platinum, palladium, ruthenium, rhodium, osmium, and iridium. Rare earth metals are also possible, e.g., lanthanides such as lanthanum, cerium, and erbium. Elements which are chemically-similar to the lanthanides could also be included, such as scandium and yttrium. In some instances, it may also be desirable to include one or more of iron, chromium, and cobalt. Moreover, those skilled in the art understand that aluminum-based powder may also contain various other elements and other materials at impurity levels.

The amount of the aluminum-based powder in the composition depends in large part on the amount of aluminum needed for the substrate. In general, the aluminum in the composition will be present in an amount sufficient to compensate for any projected loss of aluminum from the substrate, under projected operating conditions. The operating condition parameters include temperature levels, temperature/time schedules and cycles, and environmental conditions.

Frequently, the amount of aluminum in the composition is calculated to exceed the amount of aluminum present in the substrate itself by up to about 65 atomic %. In terms of weight percentages, the amount of aluminum in the composition is often in the range of about 0.5% by weight to about 45% by weight. In more specific embodiments, the amount of aluminum is in the range of about 30% by weight to about 40% by weight. (Depending on the particular requirements for the substrate these aluminum levels may be adjusted to allow for the presence of other metals intended for diffusion, as described herein).

In another aspect, the aluminum-based powder comprises an alloy of aluminum and silicon. The silicon in the aluminum-silicon alloy serves, in part, to decrease the melting point of the alloy, thereby facilitating the aluminizing process, as described below. In some embodiments, the silicon is present in an amount sufficient to decrease the melting point of the alloy to below about 610° C. Usually, the silicon is present in the alloy at a level in the range of about 1% by weight to about 20% by weight, based on the combined weight of the silicon and aluminum. In some embodiments, the silicon is present at a level in the range of about 10% by weight to about 15% by weight.

A variety of other components may be used in the composition. Most of them are well-known in areas of chemical processing and ceramics processing. Non-limiting examples of these additives are pigments, diluents, curing agents, dispersants, deflocculants, anti-settling agents, anti-foaming agents, binders, plasticizers, emollients, surfactants, driers, extenders, and lubricants. In general, the additives are used at a level in the range of about 0.01% by weight to about 10% by weight, based on the weight of the entire composition.

In aqueous-based composition embodiments, the binder comprises the colloidal silica. The term "colloidal silica" is meant to embrace any dispersion of fine particles of silica in a medium of water or another solvent. In such embodiments, the composition is typically aqueous. In other words, it includes a liquid carrier which is primarily water, i.e., the medium in which the colloidal silica is often employed. As used herein, "aqueous" refers to compositions in which at least about 65% of the volatile components are water. In one embodiment, at least about 80% of the volatile components are water. Thus, a limited amount of other liquids may be used in admixture with the water. Non-limiting examples of the other liquids or "carriers" include alcohols, e.g., lower alcohols with 1-4 carbon atoms in the main chain, such as ethanol. Halogenated hydrocarbon solvents are another example.

Selection of a particular carrier composition will depend on various factors, such as: the evaporation rate required during treatment of the substrate with the composition; the effect of the carrier on the adhesion of the composition to the substrate; the solubility of additives and other components in the carrier; the "dispersability" of powders in the carrier; the carrier's ability to wet the substrate and modify the rheology of the composition; as well as handling requirements; cost requirements; and environmental/safety concerns. Those of ordinary skill in the art can select the most appropriate carrier composition by considering these factors. The amount of liquid carrier employed is usually the minimum amount sufficient to keep the solid components of a slurry in suspension. Amounts greater than that level may be used to adjust the viscosity of the composition, depending on the technique used to apply the composition to a substrate. In general, the liquid carrier will comprise about 30% by weight to about 70% by weight of the entire composition.

Dispersions of colloidal silica are available from various chemical manufacturers, in either acidic or basic form. Moreover, various shapes of silica particles can be used, for example, spherical, hollow, porous, rod, plate, flake, or fibrous, as well as amorphous silica powder. The particles usually (but not always) have an average particle size in the range of about 10 nanometers to about 100 nanometers. The amount of colloidal silica present in the composition will depend on various factors. They include, for example: the amount of aluminum-based powder being used and the presence (and amount) of an organic stabilizer, as described below. Processing conditions are also a consideration. Usually, the colloidal silica is present at a level in the range of about 5% by weight to about 20% by weight, based on silica solids as a percentage of the entire composition. In more specific embodiments, the amount is in the range of about 10% by weight to about 15% by weight.

In another more specific aspect, the composition further comprises at least one organic stabilizer which contains at least two hydroxyl groups. In still more specific examples which may be used either separately or in combination: the organic stabilizer includes at least three hydroxyl groups; the organic stabilizer is selected from the group consisting of alkane diols, glycerol, pentaerythritol, fats, and carbohydrates; the carbohydrate is a sugar compound; the organic stabilizer is present in an amount sufficient to chemically stabilize the aluminum-based powder during contact with any aqueous component present in the composition; and the organic stabilizer is present at a level in the range of about 0.1% by weight to about 20% by weight, based on the total weight of the composition. Even more specific examples of stabilizers are provided in aforementioned U.S. patent Ser. Nos. 10/633,888 and 10/633,887.

In organic-based composition embodiments, the binder comprises at least one organic resin. As used herein, an "organic-based" composition is meant to describe a material which contains at least one synthetic resin or drying oil as the film-forming component, along with one or more solvents. Such materials often take the form of commercial coatings or paints, with the latter term usually being used when the coating includes pigment. The organic-based compositions wherein the binder comprises at least one organic resin are generally non-aqueous, i.e., containing no water, or only limited amounts of water. The absence of water is often advantageous for such compositions. For example, the instability which might otherwise result from contact between water and the aluminum-based powder can be substantially eliminated.

Non-limiting examples of useful organic resins include: epoxy resins, silicone resins, alkyd resins, acrylic resins, polyurethane resins, polyvinyl chloride resins, phenolic resins, polyester resins, urethane resins, polyamide resins, polyolefin resins, and combinations thereof. One more specific example of an epoxy resin is bisphenol A. Several more specific examples of silicone resins are a modified or unmodified silicone varnish, at least one organopolysiloxane, a silicone alkyd, a silicone epoxy, or a silicone polyester. One more specific example of an alkyd resin is the reaction product of phthalic anhydride and glycerol. In such embodiments, it is useful (although not required) to employ at least one organic solvent. Non-limiting examples of such solvents include alcohols, glycols, ketones, aldehydes, aromatic compounds, dimethylformamide, mineral spirits, naphtha, nitrated hydrocarbons, chlorinated hydrocarbons, and combinations thereof. More specific descriptions of such resins are provided in aforementioned U.S. patent Ser. Nos. 10/633,888 and 10/633,887.

The above-described embodiments and options can be used in any desired combination. For example, in one combination a slurry coating composition is provided for applying aluminum to internal passages of a turbine component formed from a material comprising a nickel-based superalloy. In this embodiment, the composition is substantially free of hexavalent chromium, comprises a binder selected from the group consisting of colloidal silica, at least one organic resin, and combinations thereof, and particles of an aluminum-silicon alloy which has an average particle size in the range of about 1 micron to about 50 microns, and inert organic polymer thickener beads.

As described above, embodiments of the composition can be used for aluminizing an internal passage of a metal substrate by injecting the composition into the internal passage; heat treating the composition under conditions sufficient to remove volatile components from the composition, to cause diffusion of aluminum into surface regions of the internal passage, and to cause decomposition of at least some of the inert organic pyrolysable thickener particles; and burnishing excess material from the internal passage. In one example, the surface region of the internal passage extends to a depth of about 200 microns into the substrate. One advantage of embodiments of the present invention is internal aluminizing can be carried out simultaneously (meaning in the same diffusion heat treatment cycle) as the external aluminizing process.

EXAMPLE 1

A slurry including 10.3 g silicone aluminum enamel (Glyptal 86009), 5 g of 10 micron aluminum-based powder and 15 g of poly(methyl methacrylate) bead polymer (200 micrometer diameters) is mixed until it has the consistency of soft ice cream. The mixture is loaded into a syringe by means of a gravity funnel. The mixture is injected into the trailing edge cooling holes of a 7FA Stage Two nozzle, composed of GTD222 nickel-based superalloy. After drying, the nozzle is subjected to diffusion heat treatment under conditions such as those described in U.S. patent application Ser. Nos. 10/633,888 and 10/633,887 for the diffusion of the external aluminide coating. During this treatment the poly(methyl methacrylate) beads decompose to form a gas that escapes from the holes. The aluminum-based powder left behind is uniformly distributed and diffuses into the superalloy to form a diffusion aluminide coating.

EXAMPLE 2

A slurry is formed by mixing 5 g of glycerol, 15 g of LP30 colloidal silica, 10 g of 20% (w/w) polyvinyl alcohol (in water), 20 g of 10 to 14 micron aluminum powder, 5 g of 10 micron aluminum silicon eutectic powder and 2 g of 200 micron poly(methyl methacrylate) microbeads. The mixture is injected into the trailing edge cooling holes of a 7FA Stage Two nozzle, composed of GTD222 nickel-based superalloy. After drying, the nozzle is subjected to diffusion heat treatment under conditions such as those described in U.S. patent application Ser. Nos. 10/633,888 and 10/633,887 for the diffusion of the external aluminide coating. During this treatment the poly(methyl methacrylate) beads decompose to form a gas that escapes from the holes. The aluminum-based powder left behind is uniformly distributed and diffuses into the superalloy to form a diffusion aluminide coating. Residual aluminum powder is removed mechanically or by brief immersion in 0.5 N sodium hydroxide.

Examples of heat treating are described in aforementioned U.S. patent application Ser. Nos. 10/633,888 and 10/633,887 and may be used separately or in combination. These examples include: performing a preliminary heat treatment to remove the volatile components and a final heat treatment to diffuse the aluminum into the substrate; carrying out the heat treatment at a temperature in the range of about 650° C. to about 1100° C.; performing a graduated heat treatment.

Examples of mixing are additionally described in aforementioned U.S. patent application Ser. Nos. 10/633,888 and 10/633,887. Typically the additives mentioned above, if used, are usually added after the primary ingredients have been mixed, although this will depend in part on the nature of the additive. For embodiments which utilize an organic stabilizer in conjunction with the aluminum-based powder and a colloidal silica, certain blending sequences are highly useful in some instances. For example, the organic stabilizer is usually first mixed with the aluminum-based powder, prior to any significant contact between the aluminum-based powder and the aqueous carrier. A limited portion of the colloidal silica, e.g., one-half or less of the formulated amount, may also be included at this time (and added slowly), to enhance the shear characteristics of the mixture. The remaining portion of the colloidal silica is then added and thoroughly mixed into the blend. The other optional additives can also be added at this time. In some instances, it may be desirable to wait for a period of time, e.g., up to about 24 hours or more, prior to adding the remaining colloidal silica. This waiting period may enhance the "wetting" of the alumina with the stabilizer, but does not always appear to be necessary.

Burnishing can be performed by any convenient method. For example, in one embodiment, burnishing comprises inserting a burnishing tool in the internal passage. One example of a burnishing tool is a needle. Burning tools are easiest to implement in straight internal passages. Embodiments wherein burnishing comprises dissolving the excess material can be used in straight or curved internal passages. In one example, dissolving comprises chemically burnishing the excess material using sodium hydroxide at 0.5 N (½ mole per liter).

Another embodiment of the present invention is a metal substrate having a coating disposed on an internal passage, the coating being free of hexavalent chromium, and comprising aluminum-based powder, an inert organic pyrolysable thickener, and a binder selected from the group consisting of colloidal silica, at least one organic resin, and combinations thereof. Materials described above with respect to the composition embodiment are applicable in the substrate embodiment.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method for aluminizing an internal passage of a metal substrate comprising:

injecting an aluminizing composition comprising an aluminum-based powder, a binder selected from the group consisting of colloidal silica, at least one organic resin, and combinations thereof, and inert organic pyrolysable thickener particles into the internal passage;

heat treating the composition under conditions sufficient to remove volatile components from the composition, to cause diffusion of aluminum into surface regions of the internal passage, and to cause decomposition of at least some of the pyrolysable thickener particles; and burnishing excess material from the internal passage.

2. The method of claim 1 wherein burnishing comprises inserting a burnishing tool in the internal passage.

3. The method of claim 1 wherein burnishing comprises dissolving the excess material.

4. The method of claim 3 wherein dissolving comprises chemically burnishing the excess material using sodium hydroxide.

5. The method of claim 1 wherein a structure of the pyrolysable thickner particles is selected from the group consisting of beads, yarns, strings, fibers, and combinations thereof.

6. The method of claim 5 wherein the pyrolysable thickner particles comprise acrylic.

7. The method of claim 1 wherein the pyrolysable thickener particles comprise polymeric microbeads.

8. The method of claim 1 wherein the pyrolysable thickener particles comprise poly(methyl methacrylate) beads.

9. The method of claim 1 wherein the composition further comprises a water-soluble polymeric thickener.

10. The method of claim 9 wherein the polymeric thickener comprises polyvinyl alcohol.

11. The method of claim 1 wherein the aluminum-based powder in the composition comprises an alloy of aluminum and silicon.

12. The method of claim 1 wherein the binder comprise colloidal silica and an organic stabilizer which includes at least two hydroxyl groups.

13. The method of claim 12 wherein the organic stabilizer is selected from the group consisting of alkane diols, glycerol, pentaerythritol, fats, and carbohydrates.

14. The method of claim 12 wherein the aluminum-based powder in the composition comprises an alloy of aluminum and silicon.

15. The method of claim 1 wherein heat treating comprises performing a preliminary heat treatment to remove the volatile components and a final heat treatment to diffuse the aluminum into the substrate.

16. The method of claim 1 wherein the heat treatment is carried out at a temperature in the range of about 650° C. to about 1100° C.

17. The method of claim 1 wherein heat treating comprises performing a graduated heat treatment.

18. The method of claim 1 wherein the surface region of the internal passage extends to a depth of about 200 microns into the substrate.

19. A metal substrate, having a coating disposed on an internal passage, said coating being free of hexavalent chromium, and comprising aluminum-based powder, an inert organic pyrolysable thickener particles, and a binder selected from the group consisting of colloidal silica, at least one organic resin, and combinations thereof.

20. The metal substrate of claim 19 wherein the aluminum-based powder comprises an alloy of aluminum and silicon.

21. The metal substrate of claim 19 wherein the coating further comprises at least one organic stabilizer which includes at least two hydroxyl groups.

22. The metal substrate of claim 19 comprising a turbine engine component formed of a nickel-based superalloy.

23. The metal substrate of claim 19 wherein the binder comprises an organic resin selected from the group consisting of epoxy resins, silicone resins, alkyd resins, acrylic resins, polyurethane resins, polyvinyl chloride resins, phenolic resins, polyester resins, urethane resins, polyamide resins, polyolefin resins, and combinations thereof.

* * * * *